US006123062A

United States Patent [19]

Rapoport et al.

[11] Patent Number: 6,123,062

[45] **Date of Patent: *Sep. 26, 2000**

[54] SPARK IGNITION SYSTEM HAVING A CAPACITIVE DISCHARGE SYSTEM AND A MAGNETIC CORE-COIL ASSEMBLY

[75] Inventors: William Ross Rapoport, Bridgewater, N.J.; Paul Alexander Papanestor, Milford, Pa.

[73] Assignee: AlliedSignal Inc., Morris Township, N.J.

[ * ] Notice: This patent is subject to a terminal disclaimer.

[21] Appl. No.: 09/096,022

[22] Filed: Jun. 11, 1998

Related U.S. Application Data

[63] Continuation-in-part of application No. 08/790,339, Jan. 27, 1997, Pat. No. 5,841,336, which is a continuation-in-part of application No. 08/639,498, Apr. 29, 1996, Pat. No. 5,844,462.

[51] Int. Cl.[7] ..... F02P 3/08

[52] U.S. Cl. ..... 123/598; 123/605

[58] Field of Search ..... 123/598, 605

[56] References Cited

U.S. PATENT DOCUMENTS

| | | | |
|---|---|---|---|
| 4,616,241 | 10/1986 | Yoshinari | 123/598 |
| 4,688,538 | 8/1987 | Ward et al. | 123/598 |
| 4,846,129 | 7/1989 | Noble | 123/425 |
| 5,163,411 | 11/1992 | Koiwa et al. | 123/605 |

OTHER PUBLICATIONS

WO 97 41576 A (Allied Signal Inc) Nov. 6, 1997 see p. 8, line 17—p. 16, line 5.

Patent Abstracts Of Japan vol. 012, No. 254 (E–634), Jul. 16, 1988 & JP 63 041008 A (Hitachi Ltd), Feb. 22, 1988 see abstract.

*Primary Examiner*—Willis R. Wolfe
*Assistant Examiner*—Arnold Castro
*Attorney, Agent, or Firm*—John A. Squires

[57] ABSTRACT

A spark ignition system for an internal combustion engine has a capacitive discharge (CD) system connected to a coil-per-plug (CCP) magnetic core-coil assembly. The spark ignition system is connected to a spark plug and is adapted to initiate an ignition wherein a spark is produced across the gap of the spark plug. The spark ignition system includes a magnetic core-coil assembly having an amorphous metal magnetic core, a primary coil and a secondary coil for a high voltage output to be fed to a spark plug. The CD system is charged and rapidly discharged through the primary coil of the magnetic core-coil assembly using a silicon controlled rectifier (SCR) as the switch. Operation of the SCR is controlled by circuitry that controls the firing of the spark ignition system. The magnetic core-coil assembly acts as a pulse transformer, so that voltage across its secondary coil is related to the turns ratio of secondary to primary.

16 Claims, 5 Drawing Sheets

SPARK IGNITION SYSTEM HAVING A CAPACITIVE DISCHARGE SYSTEM AND A MAGNETIC CORE-COIL ASSEMBLY

CROSS-REFERENCE TO RELATED APPLICATIONS

This is a continuation-in-part of U.S. application Ser. No. 08/790,339, filed Jan. 27, 1997 now U.S. Pat. No. 5,841,336, issued on Nov. 24, 1998 which in turn, is a continuation-in-part of Ser. No. 08/639,498, filed Apr. 29, 1996 now U.S. Pat. No. 5,844,462, issued on Dec. 1, 1998.

BACKGROUND OF THE INVENTION

1. Field of the Invention

This invention relates to spark ignition systems for internal combustion engines; and more particularly to a spark ignition system including a capacitive discharge system and a core-coil assembly which improves performance of the engine system and reduces the size of the magnetic components in the spark ignition transformer in a commercially producible manner.

2. Description of the Prior Art

In a spark-ignition internal combustion engine, a flyback transformer is commonly used to generate the high voltage needed to create an arc across the gap of the spark plug and cause an ignition event, i.e., igniting the fuel and air mixture within the engine cylinder. The timing of this ignition spark event is critical for best fuel economy and low exhaust emission of environmentally hazardous gases. A spark event which is too late leads to loss of engine power and efficiency. Correct spark timing is dependent on engine speed and load. Each cylinder of an engine often requires different timing for optimum performance. Different spark timing for each cylinder can be obtained by providing a spark ignition transformer for each spark plug.

To improve engine efficiency and alleviate some of the problems associated with inappropriate ignition spark timing, some engines have been equipped with microprocessor-controlled systems which include sensors for engine speed, intake air temperature and pressure, engine temperature, exhaust gas oxygen content, and sensors to detect "ping" or "knock".

A disproportionately greater amount of exhaust emission of hazardous gases is created during the initial operation of a cold engine and during idle and off-idle operation. Studies have shown that rapid multi-sparking of the spark plug for each ignition event during these two regimes of engine operation reduces hazardous exhaust emissions. Accordingly, it is desirable to have a fast cycling spark ignition system.

Engine misfiring increases hazardous exhaust emissions. Numerous cold starts without adequate heat in the spark plug insulator in the combustion chamber can lead to misfires, due to deposition of soot on the insulator. The electrically conductive soot reduces the voltage increase available for a spark event. A spark ignition transformer which provides an extremely rapid rise in voltage can minimize the misfires due to soot fouling.

A coil-per-spark plug (CPP) ignition arrangement in which the spark ignition transformer is mounted directly to the spark plug terminal, eliminating a high voltage wire between the conventional engine coil and spark plug, is gaining acceptance as a method for improving the spark ignition timing of internal combustion engines. One example of a CPP ignition arrangement is disclosed in U.S. Pat. No. 4,846,129 to Noble (hereinafter "the Noble patent"). The physical diameter of the spark ignition transformer must fit into the same engine spark plug well in which the spark plug is mounted. To achieve the engine diagnostic goals envisioned in the noble patent, the patentee discloses an indirect method utilizing a ferrite core. Ideally the magnetic performance of the spark ignition transformer is sufficient throughout the engine operation to sense the sparking condition in the combustion chamber.

To achieve the spark ignition performance needed for successful operation of the ignition and engine diagnostic system disclosed by Noble and, at the same time, reduce the incidence of engine misfire due to spark plug soot fouling, the spark ignition transformer's core material: (i) must have certain magnetic permeability; and (ii) must have low magnetic losses. In a capacitive discharge (CD) system, very fast rise times and rapid energy transfer are critical. The magnetic core material must be capable of high frequency response with low loss. The combination of these required properties narrows the availability of suitable core materials. Considering the target cost of an automotive spark ignition system, possible candidates for the core material include silicon steel, ferrite, and iron-based amorphous metal. Conventional silicon steel routinely used in utility transformer cores is inexpensive, but its magnetic losses are too high. Thinner gauge silicon steel with lower magnetic losses is too costly. Ferrites are inexpensive, but their saturation inductions are normally less than 0.5 Tesla (T) and Curie temperatures at which the core's magnetic induction becomes close to zero are near 200° C. This temperature is too low considering that the spark ignition transformer's upper operating temperature is assumed to be about 180° C. Iron-based amorphous metal has low magnetic loss and high saturation induction exceeding 1.5 T, however it shows relatively high permeability. An iron-based amorphous metal capable of achieving a level of magnetic permeability suitable for a spark ignition transformer is needed. Using this material, it is possible to construct a toroid design coil which meets required output specifications and physical dimension criteria. The dimensional requirements of the spark plug well limit the type of configurations that can be used. Typical dimensional requirements for insulated coil assemblies are less than 25 mm in diameter and less than 150 mm in length. These coil assemblies must also attach to the spark plug on both the high voltage terminal and outer ground connection and provide sufficient insulation to prevent arc-over from the coil to other engine components. The outer ground connection can be made via a return from the engine block, as in typical coil-per-plug systems. These must also be the ability to make high current connections to the primary coil windings typically located on top of the coil.

SUMMARY OF THE INVENTION

The present invention provides a spark ignition system for an internal combustion engine having a capacitive discharge (CD) system connected to a coil-per-plug (CCP) magnetic core-coil assembly. The spark ignition system is connected to a spark plug and is configured for initiating an ignition event, i.e. a spark, across the gap of the spark plug. The CD system includes a capacitor (typically rated at between approximately 1 and 2 microfarads) that is charged by the output of a DC-to-DC converter that steps-up the output of a twelve-volt DC battery to a voltage of between approximately 300 and 600 volts DC. The capacitor is thereafter rapidly discharged through the primary coil of the magnetic core-coil assembly using a silicon controlled rectifier (SCR) as the switch. Operation of the SCR is controlled by circuitry that controls the firing of the spark ignition system. The magnetic core-coil assembly acts as a pulse transformer so that the voltage that appears across its secondary coil is related to the turns ratio of secondary to primary. For the present invention, the optimal turns ratio between secondary and primary coils is different than that for an inductive coil system. A more traditional high performance coil for capacitive discharge applications has a 30 turn primary and a 2,500 turn secondary. Peak secondary current is approximately 1 ampere and discharge time is approximately 140 microseconds. Typically the core-coil assembly of this CD system has between 2 and 4 turns in the primary coil and between 150 and 250 turns in the secondary coil. The peak secondary current is approximately 3 amperes and the discharge time is approximately 60 microseconds. The output pulse-width defined as current flow through the secondary winding and the arc of the spark plug is the same as the storage capacitor discharge time through the primary. The discharge time of such a core-coil assembly would be very short due to core saturation. The efficient toroidal design and high frequency characteristics of the amorphous metal cores efficiently transfer energy to the secondary coil of the core-coil assembly. Typical peak discharge currents into the spark plug gap are in the several ampere range and the discharge times are typically under 60 microseconds. The low real resistance of the magnetic core-coil assembly allows for good impedance matching of the spark plug gap discharge to the core-coil assembly.

Generally stated, the magnetic core-coil assembly of the present invention comprises a magnetic core composed of a ferromagnetic amorphous metal alloy which has low magnetic losses coupled with fewer primary and secondary coil windings due to the magnetic permeability of the core material. The core-coil assembly has a single primary coil connected to the CD system for voltage excitation therefrom and a secondary coil for a high voltage output. The secondary coil comprises a plurality of core-coil sub-assemblies, each having an amorphous metal core and a coil. The coils of the core-coil sub-assemblies are alternately wound in the clockwise and counter-clockwise directions such that adjacent coils are not wound in the same direction. The alternating coil windings of the core-coil sub-assemblies provide a high voltage output from the secondary coil that is the sum of the voltages generated by each of the core-coil sub-assemblies. When the main storage capacitor of the CD system discharges, the core-coil assembly acts as a pulse transformer; stepping-up the voltage output from the CD system (i.e. between approximately 300 and 600 volts DC) based on the turns ratio of secondary to primary coil of the core-coil assembly. The output voltage generated by the core-coil assembly of the present invention can exceed 30 kilovolts (kV) The low number of primary and secondary coil windings (i.e. turns) provide a core-coil assembly having a lower resistance and inductances than prior art inductive core-coil assemblies. As a result, the present invention provides improved multi-strike capabilities, when compared to prior art core-coil assemblies, due in part to the rapid discharge time of the main storage capacitor of the CD system, which is related to the overall construction of the core-coil assembly.

More specifically, the core of the core-coil assembly is composed of an amorphous ferromagnetic material which exhibits low core loss and a permeability (ranging from about 100 to 500). Such magnetic properties are especially suited for rapid firing of the spark plug during a combustion cycle. Misfires of the engine due to soot fouling are minimized. Moreover, energy transfer from coil to plug is carried out in a highly efficient manner. The low secondary resistance of the generally toroidal core design (typically, less than 50 ohms) provides secondary peak currents several times higher than conventional, prior art CD systems and permits the bulk of the energy to be dissipated in the spark and not in the secondary winding of the core-coil assembly. The individual secondary voltages generated across the plural core-coil sub-assemblies rapidly increase and add sub-assembly to sub-assembly based on the total magnetic flux change of the system. This allows the versatility to combine several core-coil sub-assemblies wound via existing toroidal coil winding techniques to produce a single assembly with superior performance. As a result, the core-coil assembly of the invention is less expensive to construct, and more efficient and reliable in operation than core-coil assemblies having a single secondary coil.

BRIEF DESCRIPTION OF THE DRAWINGS

The invention will be more fully understood and further advantages will become apparent when reference is made to the following detailed description of the preferred embodiments of the invention and the accompanying drawings, wherein like reference numerals denote similar elements throughout the several views and in which.

DETAILED DESCRIPTION OF THE PREFERRED EMBODIMENTS

The present invention is directed to a spark ignition system for generating an ignition event in a cylinder of an internal combustion engine. The spark ignition system is comprised of a capacitive discharge (CD) system connected to a magnetic core-coil assembly of generating a high voltage output that is fed to a spark plug. The main storage capacitor in a CD system charges to a voltage of between approximately 300 and 600 volts DC. The capacitor is then discharged through the primary winding of the core-coil assembly, which acts as a pulse transformer, rapidly inducing a voltage in the secondary coil having a magnitude that is related to the turns ratio between the primary and secondary coils. The output voltage generated by the core-coil assembly of the present invention can exceed 30 kilovolts (kV). The low number of primary and secondary coil windings (i.e. turns) provide a core-coil assembly having a lower resistance and inductance than prior art inductive core-coil assemblies. As a result, the present invention provides improved multi-strike capabilities, when compared to prior art core-coil assemblies, due in part to the rapid discharge time of the main storage capacitor of the CD system, which is related to the overall construction of the core-coil assembly. The discharge time of the CD system ranges from about 60 microseconds to about 200 microseconds. The toroidal design and high frequency performance characteristics of the cores of the primary and secondary coils transfer energy from the primary coil to the secondary coil in an efficient manner.

Figure 1:
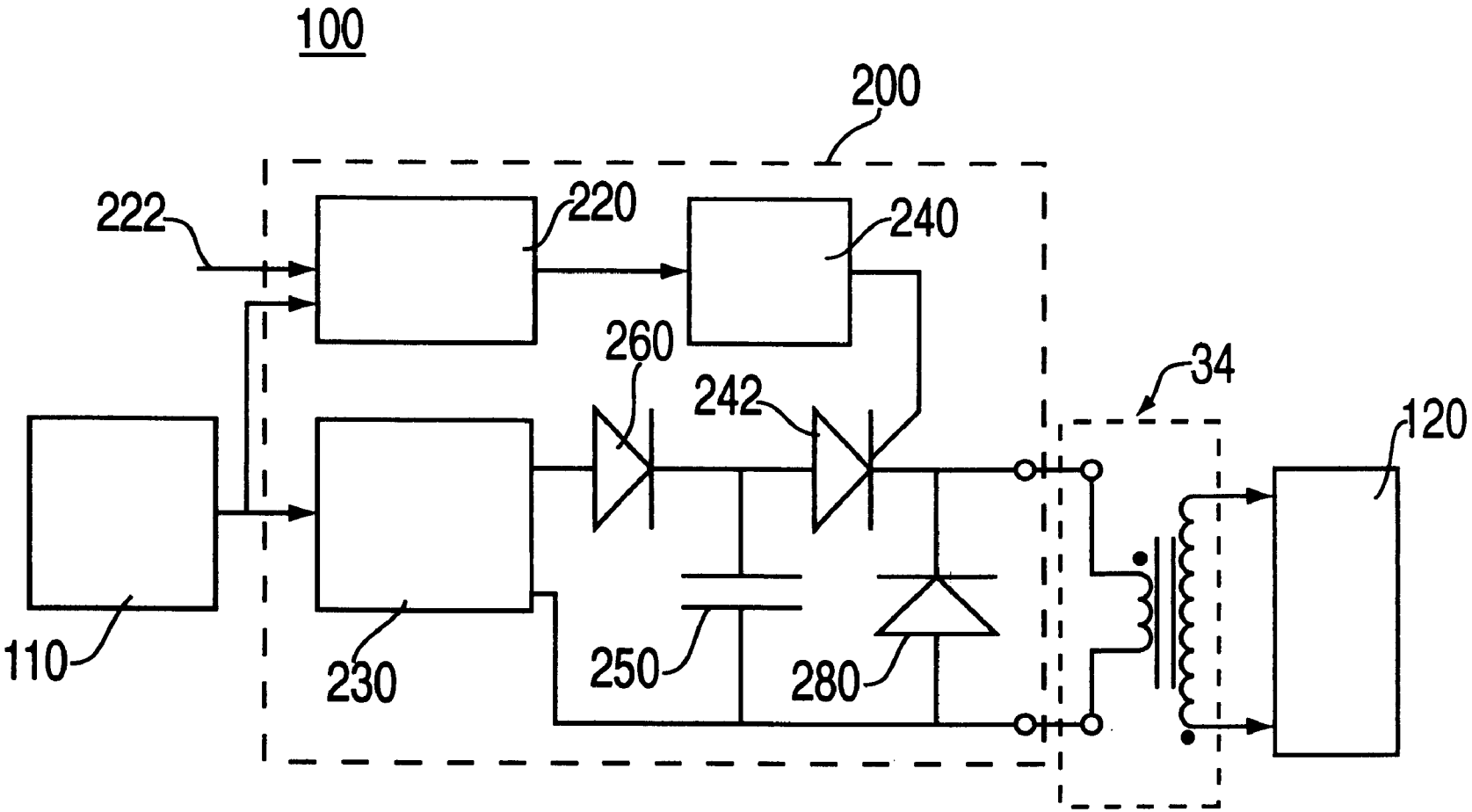
FIG. 1 is a block diagram of a spark ignition system having a capacitive discharge system connected to a magnetic core-coil assembly for initiating an ignition event in a spark plug of an internal combustion engine configured in accordance with the present invention.

Referring now the drawings in detail, FIG. 1 is a block diagram of a spark ignition system 100 comprised of a capacitive discharge (CD) system 200 connected to a magnetic core-coil assembly 34, and configured in accordance with the present invention for generating an ignition event in a spark plug 120 located in a cylinder of an internal combustion engine (not shown). The CD system 200 includes a DC-to-DC voltage converter 230 that increases the voltage from the power source 110, which is typically a twelve-volt battery, to between approximately 300 and 600 volts DC. The voltage output (i.e. 300 to 600 volts DC) from the converter 230 charges a main storage capacitor 250 through a first diode 260. The storage capacitor 250 is a ceramic capacitor rated at a value of between approximately 1 and 2 microfarads. The storage capacitor 250 preferably charges to the voltage output of the converter 230 (i.e. between approximately 300 and 600 volts DC). The discharge of the capacitor 250 is controlled by a silicon rectifier (SCR) 242 that is turned on by SCR trigger 240, in response to logic signals received by the SCR trigger 240 from logic circuitry 220. The logic circuitry 220 is connected to the power source 110 and receives a firing signal input 222 that is processed by the logic circuitry 220 to control the SCR trigger 240. Firing signals are usually generated by a pickup coil (not shown) and a spinning reluctor (not shown). The reluctor is like a spinning gear and generates voltage as if it were a moving magnet. When the gear tooth moves closes to the pickup coil a positive voltage is induced in the coil, as the reluctor moves away from the coil, a negative voltage is induced. The location of the reluctors and pickup coil determine the firing time. The reluctor can also be located on the crank shaft. A gear isn't the only method, a plate with holes will have the same effect. When the storage capacitor 250 is fully charged, the SCR 242 is activated by the SCR trigger 240 and the storage capacitor 250 discharges through the SCR 242 causing a current to flow in the primary coil 36 (see, e.g. FIG. 2) of the core-coil assembly 34. The voltage generated in the primary coil 36 by the current from the storage capacitor 250 is increased from the primary coil 36 to the secondary coil 20 in proportion to the turns ratio between the primary coil 36 and secondary coil 20. The voltage generated across the secondary coil 20 is fed to a spark plug 120 thereby causing an ignition event at the spark plug 120. A second diode 280 is connected across the output of the CD system 200 to prevent reverse polarity voltage signals from the core-coil assembly 34 from being fed back into the CD system 200. The discharge time of the CD system 200 is determined by the capacitance, inductance and resistance of the discharge path within the CD system 200 and the primary coil 36 of the core-coil assembly 34. The discharge time of the CD system 200 ranges from about 60 microseconds to about 200 microseconds an determines, at least in part, the multi-strike frequency of the present invention. Typically, the storage capacitor 250 is chosen for very low resistance characteristics (e.g., low equivalent series resistance (ESR)). The main inductance comes from the primary coil 36 of the core-coil assembly 34. The primary source of resistance in the CD system 200 is the wire leads and the wore in the primary coil 36 of the core-coil assembly 34, and the ESR of the storage capacitor 250.

Figure 2:
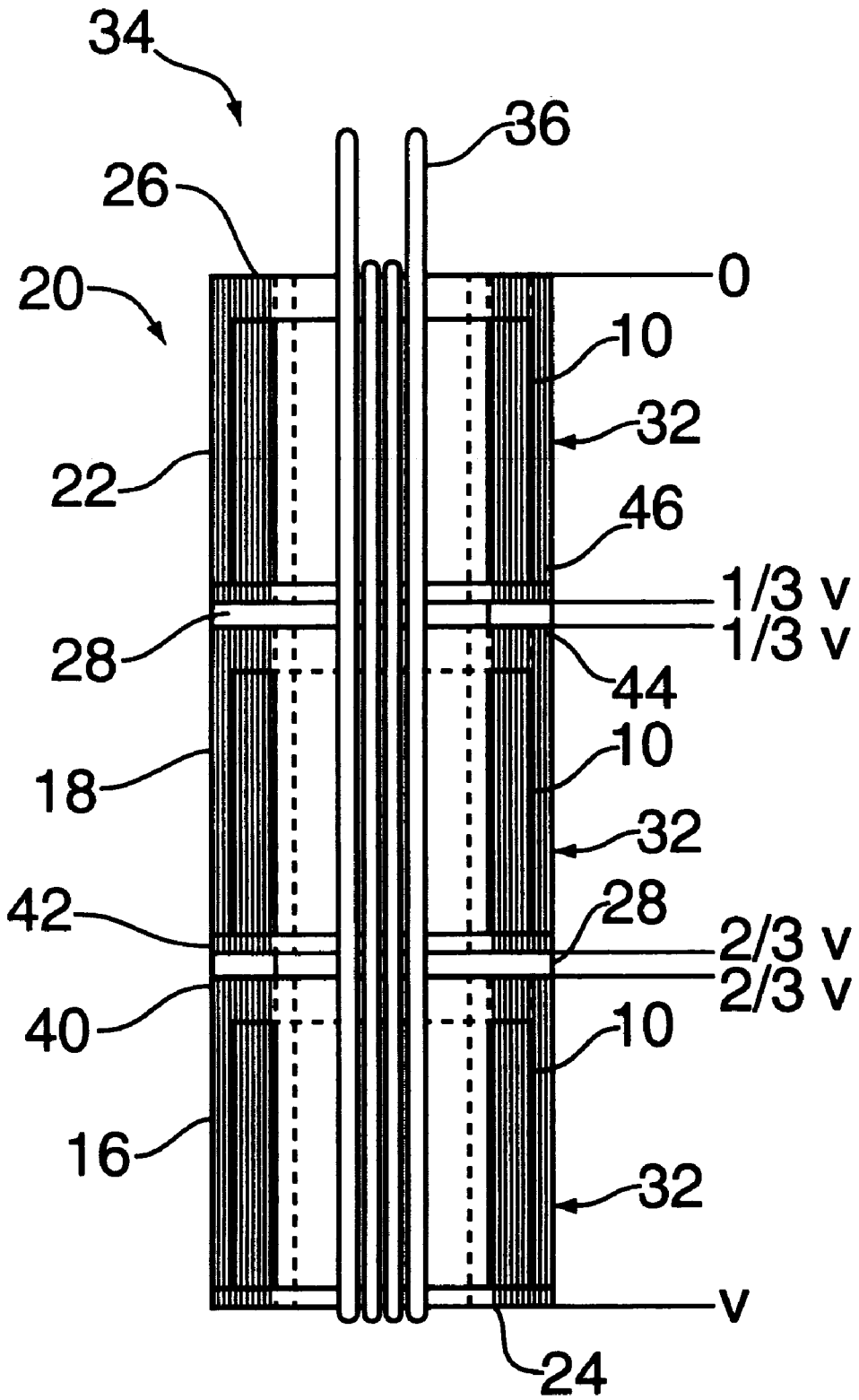
FIG. 2 depicts the core-coil assembly of FIG. 1 having a secondary coil comprised of three stacked core-coil sub-assemblies.
Figure 3D:
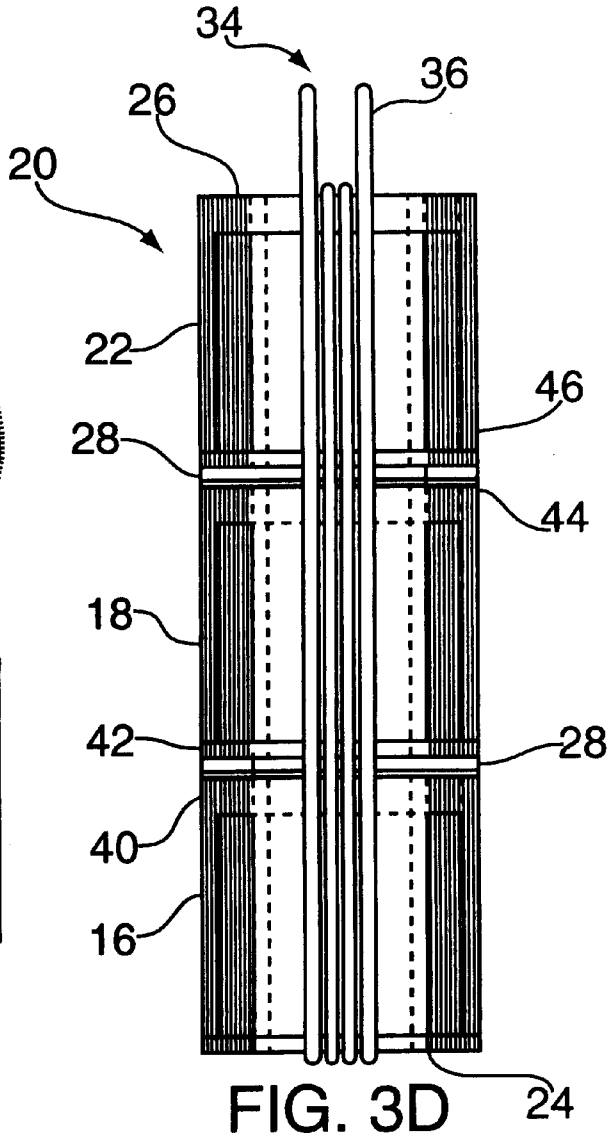
FIGS. 3A–3D depict an assembly sequence for producing the core-coil assembly of FIG. 2 using a gapped amorphous metal alloy core.
Figure 3C:
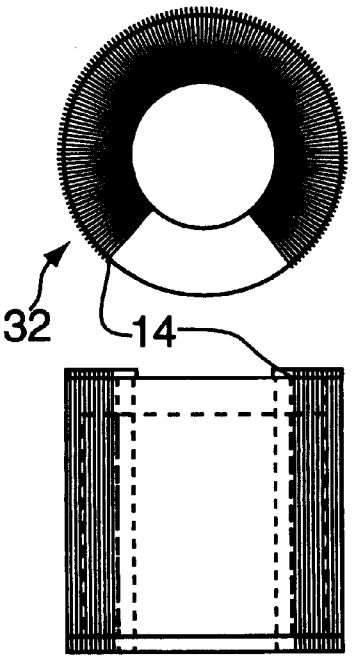
Figure 3B:
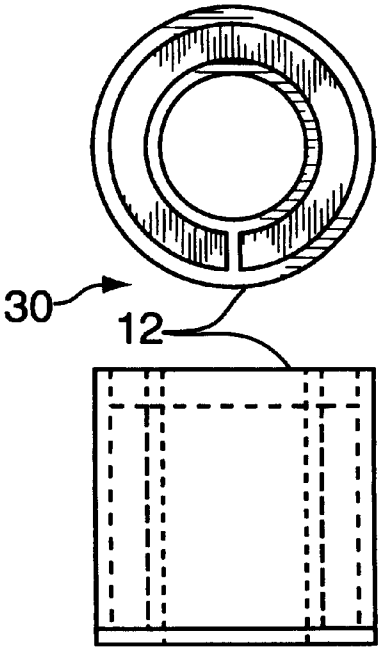
Figure 3A:
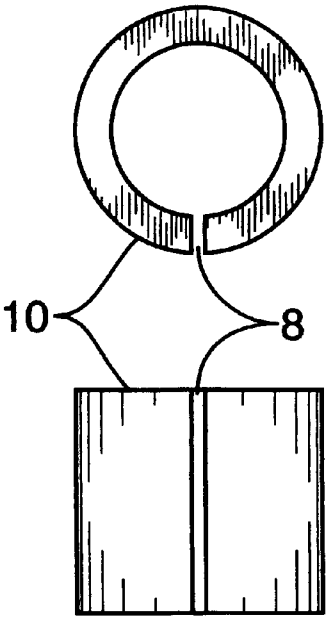

Referring next to FIG. 2, the magnetic core-coil assembly 34 of the present invention includes a common primary coil 36 that is connected to the CD system 200 for voltage excitation therefrom and a secondary coil 20 connected to a spark plug 120 for generating a high voltage output. The secondary coil 20 comprises a plurality of generally toroidal core-coil sub-assemblies 32 each having a magnetic core 10 composed of a ferromagnetic amorphous metal allow and a secondary coil 16, 18 and 22 wound thereabouts. The secondary coils 16, 18 and 22 of the core-coil sub-assemblies 32 are serially connected to each other and alternately wound in the clockwise (cw) and counterclockwise (ccw) directions so that adjacently stacked sub-assemblies 32 are not wound in the same direction. The core-coil sub-assemblies 32 are simultaneously energized from the CD system 200 and via the common primary coil 36 and when so energized, produce additive secondary voltages that are additive and collectively fed to a spark plug 120 as a single, high voltage output of the secondary coil 20. Typically, the secondary coil 20 is arranged such that the high voltage output that is delivered to the center electrode of the spark plug 120 is negative.

The magnetic core 10 is preferably formed of an amorphous metal alloy having a high magnetic induction, which includes iron-based alloys. Two basic forms of a core 10 are noted. They are gapped (see, e.g. FIGS. 3A–3D) and non-gapped (see, e.g. FIGS. 4A–4D); both being referred to herein as core 10. The gapped core 10 has a peripherally discontinuous magnetic section over a magnetically continuous path. An example of such a core 10 is a toroidal-shaped magnetic core having a small slit 8 that extends the length of the core 10 and which is known in the art as an air-gap. The slit 8 is typically on the order of a few thousandths of an inch in width. Location of the slit 8 with respect to the primary and secondary coils 36, 20 is a routine matter of design choice. The gapped configuration is adopted when the needed permeability of the core 10 is considerably lower than the core's as-wound permeability since the air-gap portion of the magnetic path reduces the overall core permeability. The non-gaped core 10 has a magnetic permeability similar to that of an air-gapped core 20 obtained via a post-processing method such as, for example, time-temperature annealing, but is physically continuous, having a structure similar to that found in a typical toroidal magnetic core. Both gapped and non-gapped configurations may be used in accordance with the present invention and are thus interchangeable as long as the effective core permeability is within the desired range. Accordingly, it is to be understood that the discussion herein directed to a non-gapped core 10 applies equally to a gapped core 10; the non-gapped core 10 being discussed by way of a non-limiting illustrative example of an amorphous metal alloy core 10 of the present invention. Non-gapped cores 10 were chosen for the proof of principle of this modular design, however the design is not limited to the use of non-gapped core material.

The core 10 is made of an amorphous metal alloy based on iron alloys and formed so that the core's magnetic permeability is between 100 and 500 as measured at a frequency of approximately 1 kHz. To improve the efficiency of non-gapped cores 10 by reducing eddy current losses, shorter core cylinders are wound and processed and stacked end-to-end to obtain the desired amount of magnetic core. Leakage flux from a non-gapped core 10 is much less than that from a gapped core 10, emanating less undesirable radio frequency interference into the surroundings. The core-coil assembly 34 depicted in FIG. 1 has, by way of non-limiting example, a secondary coil 20 having between approximately 150 and 200 winding turns. Typical secondary coil 20 to primary coil 36 turns ratios are in the 50–100 range. Since the core-coil assembly 34 operates as a pulse transformer, very little energy is stored in the primary coil 36 but instead, is rapidly transferred to the secondary coil 20. A prime source of energy is required for tis operation, namely, the storage capacitor 250 of the CD system 200 depicted in FIG. 1. The storage capacitor 250 is typically rated at between approximately 1 and 2 microfarads and is typically charged to between approximately 300 and 600 volts DC prior to being discharged. Charging is typically done via the DC-to-DC voltage converter 230 which converts the nominal battery voltage 110 (typically approximately twelve-volts DC) to the desired 300 to 600 voltage level. The discharge path of the CD system 200 is from the storage capacitor 250 to the primary coil 36 of the core-coil assembly 34, through a SCR 242, which operates as a switch and back to the capacitor 250. The discharge time of the CD system ranges from about 60 microseconds to about 200 microseconds.

In the core-coil assembly 34 of the present invention, the magnetic core 10 ay saturate. The voltage step-up from primary coil 36 to secondary coil 20 is determined by the turns ratio of primary to secondary coils 36, 20, and is typically in the region of approximately 50–100, i.e. the secondary coil 20 voltage is approximately 50–100 times greater than the primary coil 36 voltage. The low resistance value of the secondary coil 20 permits very high values of peak current, typically greater than approximately 3 amps, to flow into the spark plug 120 and through the spark plug gap during an ignition event. This large current value, which is much higher than the 0.1 amps of a conventional coil, results in a hot spark generated by the spark plug 120 which in turn, provides for good combustion in the cylinder of the internal combustion engine. Since the output impedance of the core-coil assembly 34 is low, typically less than 50 ohms, and the voltage rise in the secondary coil 20 is in the sub-microsecond range, the core-coil assembly 34 of the present invention can drive very low impedance loads and can typically deliver nearly full output voltage, even across a fouled spark plug. Open circuit voltage in excess of 30 kilovolts (kV) is possible for spark ignition systems 100 configured in accordance with the present invention.

In accordance with the present invention, magnetic cores were comprised of ribbon amorphous metal material that was wound into right angle cylinders having an inside or inner diameter of 12 mm, an outside or outer diameter of 17 mm, and a height of 15.6 mm. These cores are then stacked to form an effective cylinder height of nearly 80 mm. Individual cylinder heights could be varied from a single height of near 80 mm to 10 mm as long as the total cylinder height satisfied system requirements. It is not a requirement to directly adhere to the dimensions used in this example. This is because large variations of design space exist according to the input and output requirements. The final constructed right angle cylinder formed the core as a generally elongated toroid. Insulation between the core and coil windings was achieved through the use of high temperature resistant moldable plastic which doubled as a winding form facilitating the winding of the generally toroidal core. Fine gauge wire was used to wind the desired 120–200 turns of the secondary coil 20. The best performing coils had the wires evenly spaced over approximately 180–300 degrees of the circumference of the generally toroidal core 10. The remaining 60–180 degree was used for winding the primary coil 36. See, e.g. FIGS. 3C and 4C). One of the drawbacks to this type of design was the aspect ratio of the toroidal core 10 and the number of secondary turns required for general operation. A jig to wind these coils was required to handle very fine wire (typically 39 gauge or higher), not significantly overlap these wires, and not break the wire during the winding operation. Typical toroid winding machines are not capable of winding coils near this aspect ratio due to their inherent design. Alternative designs based on shuttles that are pushed through the core and then brought around the outer perimeter were required and had to be custom produced. Typically the time to wind these coils was very long. The elongated toroid design, though functional would be difficult to mass produce at a sufficiently low cost to be commercially attractive.

Figure 4D:
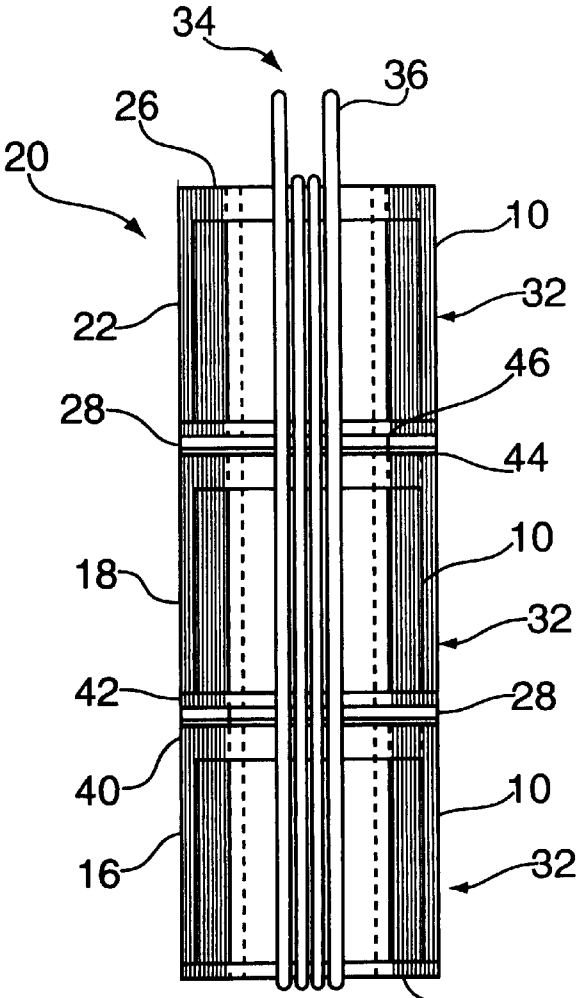
FIGS. 4A–4D depict an assembly sequence for producing the core-coil assembly of FIG. 2 using a non-gapped amorphous metal alloy core.

Referring next of FIGS. 3A–3D and 4A–4D, the construction and assembly of the core-coil assembly 34 of the present invention will now be discussed in detail. While the following discussion is directed to then on-gapped core 10 configuration depicted in FIGS. 4A–4D, it is to be understood that such discussion applies equally to the gapped core 10 configuration depicted in FIGS. 3A–3D. The secondary coil 20 is comprised of a plurality of core-coil sub-assemblies 32 each having an amorphous metal alloy core 10 and a secondary coil generally identified by reference numeral 14 (FIG. 4C), and more specifically identified by reference numerals 16, 18, 22 (FIG. 4D). Magnetic cores 10 composed of an iron-based amorphous metal alloy having a saturation induction exceeding 1.5 Tesla (T) in the as-cast state were prepared. The cores had a generally cylindrical form with a cylinder height of about 15.6 mm and outside and inside diameters of about 17 and 12 mm, respectively. These cores 10 were heat-treated with no external applied fields. The secondary coil 20 is preferably comprised of a plurality of stacked, core-coil sub-assemblies 34, each having a core 10. The plurality of core-coil sub-assemblies 34 breaks the secondary coil 20 into a smaller component level structure which can be wound using existing coil winding machines. The present invention utilizes core sections of the same base amorphous metal core material that are sized and shaped to utilize conventional, commercially available coil winding machines. This is accomplished by forming an insulator cup 12 that is sized and shaped to accept a core 10, which together form a sub-assemble 30 (see, e.g. FIG. 4B) that may be wound as a generally toroidal core-coil sub-assembly 32 (see, e.g. FIG. 4C). Each of the secondary coils 16, 18, 22 comprise the same number windings as a typical prior art secondary coil having a non-segmented or unitary core. The final core-coil assembly 34 depicted in FIG. 40 comprises a stack of serially connected core-coil sub-assemblies 32 to provide a secondary coil 20 configured for producing the desired output characteristics. The primary coil 36 is then wound about the plurality of stacked core-coil sub-assemblies 32. However, and in contrast to having a unitary core prior art secondary coil, the core-coil sub-assemblies 32 that comprise the secondary coil 20 of the present invention are alternately wound in the clockwise and counterclockwise directions such that adjacently stacked sub-assemblies 32 are not wound in the same direction. In addition to facilitating the electrical connections between the coils 16, 18, 22 of the core-coil sub-assemblies 32, this winding configuration permits the output voltages of each of the core-coil sub-assemblies 32 to add. A typical secondary coil 20 would comprise a first or bottom secondary coil 16 being wound in the counterclockwise (ccw) direction and having a lead or output wire 24 as a first output connection that connects to the spark plug 120. For ease of discussion, the end of the core-coil assembly 34 having the lead 24 will be referred to as the bottom since it typically rests on the top and is connected to the center electrode of the spark plug 120. The opposite end of the core-coil assembly 34 (having a lead 26, as discussed in detail below) will be referred to as the top since the primary coil 36 is generally accessible at this end. The second or middle secondary coil 18 would be wound in a direction opposite of the bottom secondary coil 16, i.e. in the clockwise (cw) direction, and stacked on top of the bottom secondary coil 16 with a spacer 28 to provide adequate insulation therebetween. Alternatively, the spacer 28 may be replaced with vertical rods 130 (see e.g. FIG. 4B) that extend up from the top of the insulator cup 12. These rods 130 would provide spacing between adjacent core-coil sub-assemblies 32 in a manner similar to the spacing provided by the spacer 28. The lower lead 42 of the middle secondary coil 18 is connected to the upper lead 40 of the bottom secondary coil 16. The third or top secondary coil 22 would be wound in the ccw direction and stacked on top of the middle secondary coil 18 with a spacer 28 to provide for insulation therebetween. The lower lead 46 of the top secondary coil 22 is connected to the upper lead 44 of the middle secondary coil 18. The total number of core-coil sub-assemblies 32 is set by design criteria and physical size requirements. Thus, the secondary coil 20 of the core-coil assembly 34 depicted in FIGS. 4A–4D having three core-coil sub-assemblies 32 and described in detail herein, is provided as a non-limiting illustrative example of a preferred embodiment of the present invention. The secondary coil 20 of the present invention may alternatively comprise more or less core-coil sub-assemblies 32, as dictated by design criteria, physical size requirements, and other factors. The final upper lead 26 from the top secondary coil 22 forms a second output connection of the core-coil assembly 34. Typically, lead 24 is connected to the center electrode of the spark plug and is at negative potential while lead 26 provides the return current path of the core-coil assembly 34.

Figure 4C:
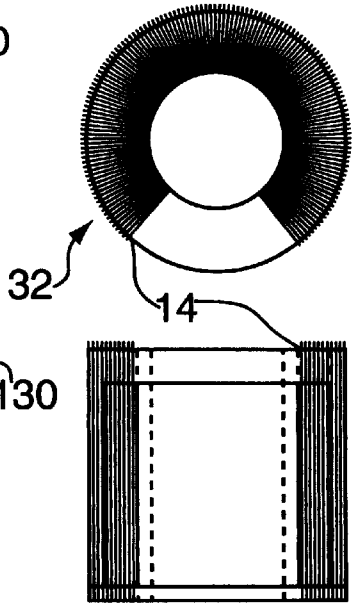
Figure 4B:
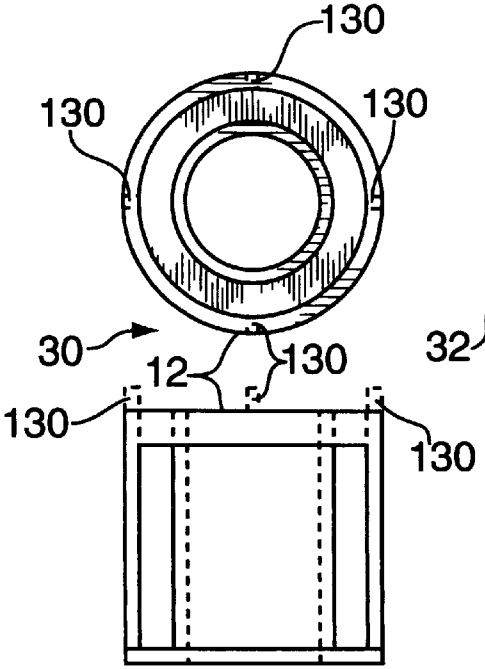
Figure 4A:
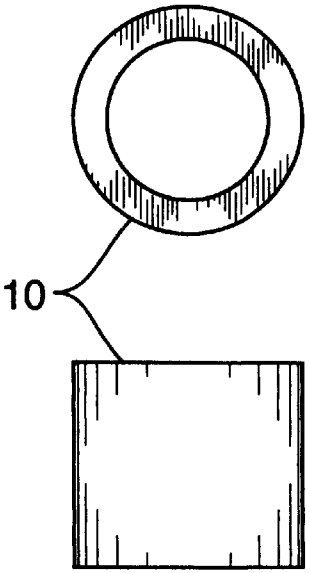

The secondary coils 16, 18, 22 of the core-coil sub-assemblies 32 are individually wound so as to cover between approximately 180–300 degrees of the circumference of the toroidally shaped core 10, as depicted in FIG. 4C. The core-coil sub-assemblies 32 are stacked so that the non-wound sections depicted in FIG. 4C, which comprise approximately between 60–180 degrees of the circumference of each core 10, are vertically aligned. A common primary coil 36 is wound in the area of the core-coil sub-assemblies 32 not covered by the secondary coils, 16, 18, 22, which comprises between approximately 60–180 degrees of the circumference of the core 10. This configuration is referred to herein as the stacker concept or configuration. The assembled core-coil assembly 34 depicted in FIG. 4D is then encased in a high temperature plastic housing (now shown) having apertures defined therein and through which the output leads 24, 26 and primary coil leads may pass. This assembly is then vacuum-cast in an acceptable potting compound for high voltage dielectric integrity. There are many alternative types of potting materials. The basic requirements of the potting compound are that it possess sufficient dielectric strength, that it adheres well to all other materials inside the structure, and that it be able to survive the stringent environment requirements of cycling, temperature, shock and vibration. It is also desirable that the potting compound have a low dielectric constant and a low loss tangent. The housing material should be injection moldable, inexpensive, possess a low dielectric constant and loss tangent, and survive the same environmental conditions as the potting compound.

The voltage distribution of a unitary or non-segmented core-coil of the prior art resembles that of a variac with the first turn of the secondary coil being at zero volts and the last turn being at full voltage. This voltage distribution is in effect over the entire height of the coil structure and thus results in voltage stress at and around the last turns of the secondary coil. The primary coil is isolated from the secondary coil and is located approximately in he center of the 60–180 degree area that is free of secondary coil windings. The primary coil windings are essentially at low potential due to the low voltage drive conditions used on the primary coil.

As depicted in FIG. 2, the voltage distribution of the core-coil assembly 34 of the present invention is advantageously different. Each individual core-coil assembly 32 has the same variac type of distribution, but, due to the stacked distribution of the secondary coil 20 of the core-coil assembly 34, the high voltage output of the secondary coil 20 is divided by the number of core-coil sub-assemblies 32. For example, if the secondary coil 20 comprises three core-coil sub-assemblies 32, as depicted in FIG. 2, the voltage across the first or bottom secondary coil 16 will range from approximately V, i.e. the full value of the high voltage output of the secondary coil 20, at lead 24 to approximately ⅔ V at lead 40. Likewise, the voltage across the second or middle secondary coil 18 will range from approximately ⅔ V at lead 42 to approximately ⅓ V at lead 44. Finally, the voltage across the third or top secondary coil 22 will range from approximately ⅓ V at lead 46 to approximately 0 V at lead 26. The voltage across each of the secondary coils 16, 18, 22 changes approximately linearly over the secondary windings, i.e. from the first coil winding to the last coil winding, from V at lead 24 to 0 V at lead 26, where lead 26 is referenced at zero volts. This configuration lessens the area of high voltage stress experienced by the secondary coils 16, 16 and 22 of the core-coil sub-assemblies 32 of the secondary coil 20.

The CD system 200 of the present invention is faster that the inductive design of the prior art allowing multiple strike capability every 70 microseconds or so. This type of system is capable of operating with a lower value of shunt resistance than the inductive design. For a input voltages ranging from approximately 6 volts DC to approximately 16 volts DC, the discharge time of the main storage capacitor 250 ranges from approximately 25 microseconds to approximately 58 microseconds. The data for FIG. 5 is for a core-coil assembly 34 having three (3) primary coil windings and 190 secondary coil windings, and with the secondary coil comprising three (3) core-coil sub-assemblies 32.

Figure 5:
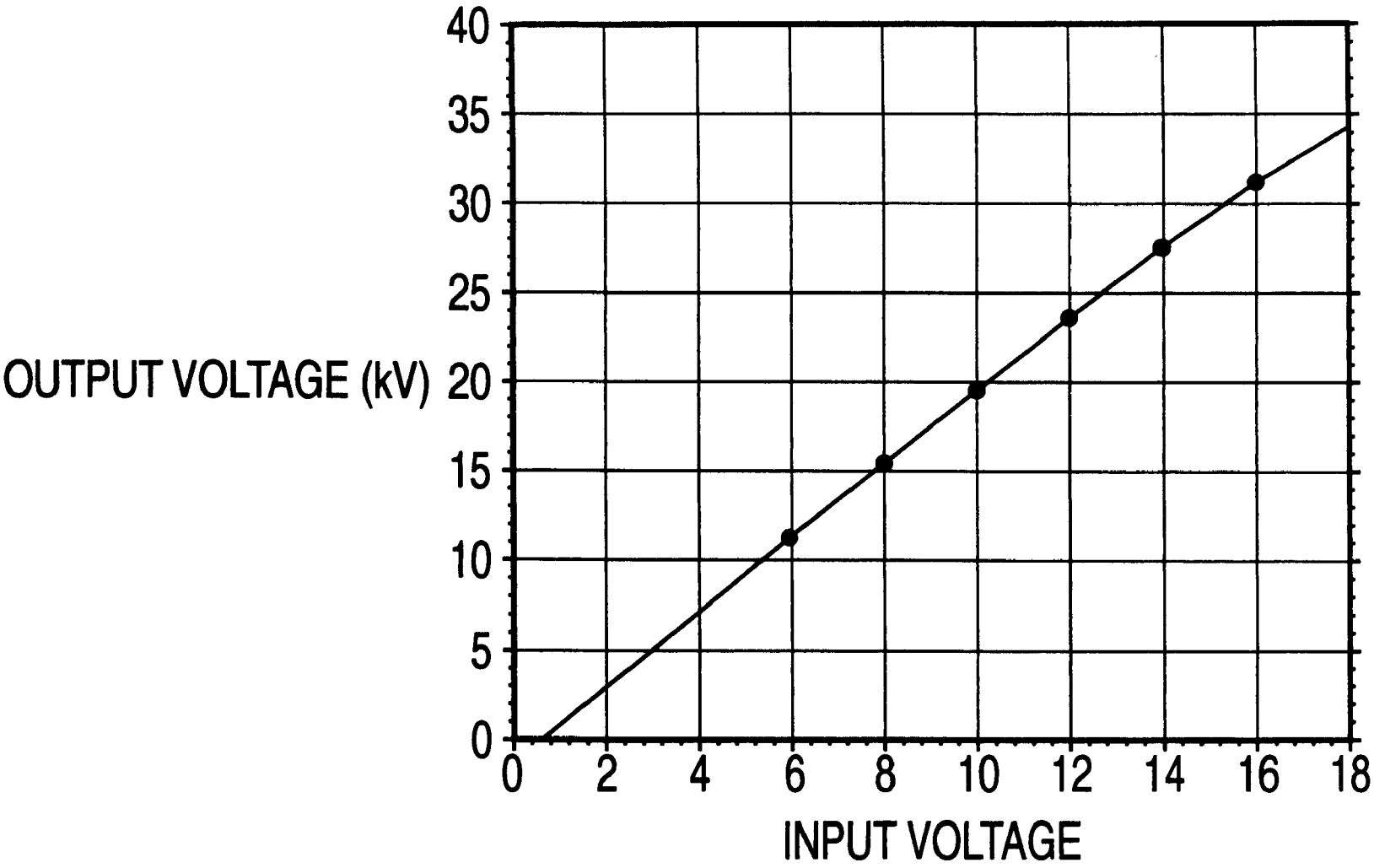
FIG. 5 is a graph depicting the output voltage across the secondary coil for given input voltages to the core-coil assembly from the capacitive discharge system for the spark ignition system of FIG. 1.

FIG. 5 graphically depicts the output voltage of the secondary coil 20 for an adjustable input voltage ranging from between approximately 0 to approximately 18 volts DC. The DC-DC converter 230 provided in the CD system 200 of the present invention steps the voltage up from that depicted on the x-axis of FIG. 5 to between approximately 300 and 600 volts DC. Notwithstanding the change in voltage values for the x-axis of FIG. 5, the relationship between the input voltage and output voltage of the spark ignition system 100 of the present invention is substantially linear, and the graph of FIG. 5 is an accurate representation of that relationship.

The following example is presented to provide a more complete understanding of the invention. The specific techniques conditions materials, proportions and reported data set forth to illustrate the principles and practice of the invention are exemplary and should not be construed as limiting the scope of the invention.

EXAMPLE

An amorphous iron-based ribbon having a width of about 15.6 mm and a thickness of about 20 $\mu$m was wound on a machined stainless steel mandreland spot welded on the inside or inner diameter and outside or outer diameter to maintain tolerance. The inside diameter of 12 mm was set by the mandrel and the outside diameter was selected to be 17 mm. The finished cylindrical core weighed about 10 grams. The cores were annealed in a nitrogen atmosphere in the 430° to 450° C. range with soak times from approximately 2 to 16 hours. The annealed cores were placed into insulator cups and wound on a toroid winding machine with 190 turns of thin gauge insulated copper wire as the secondary coil. Both counterclockwise (ccw) and clockwise (cw) units were wound. A ccw winding direction was used for the bottom and top core-coil assemblies while a cw winding direction was used for the middle assembly. Insulator spacers were added between adjacent core-coil assemblies. Three (3) turns of a lower gauge wire (lower gauge than the secondary coil windings) forming the primary coil, were wound on the stacked toroidal cores in the area where the secondary coil windings were not present. The middle and bottom core-coil sub-assemblies' leads were connected together, as were the middle and top sub-assemblies' leads. The core-coil assembly was placed in a high temperature plastic housing and was potted. With this configuration, the secondary voltage was measured as a function of the input voltage to a DC-to-DC converter in a CD system, and is graphically depicted in FIG. 5.

Having thus described the invention in rather full detail, it will be understood that such detail need not be strictly adhered to but that further changes and modifications may suggest themselves to one skilled in the art, all falling within the scope of the invention as defined by the subjoined claims.

What is claimed is:

1. A spark ignition system for generating an ignition event in an internal combustion engine having at least one combustion chamber, comprising:

a. a capacitive discharge system for repeatedly generating a predetermined voltage at a predetermined frequency;

b. a core-coil assembly connected to said capacitive discharge system for receiving said predetermined voltage, said core-coil assembly having a magnetic core composed of a ferromagnetic amorphous metal alloy, said core-coil assembly further comprising:

(i) a primary coil wound about said magnetic core and being connected to said capacitive discharge system for voltage excitation thereby; and (ii) a secondary coil wound about said magnetic core and adapted for excitation by said primary coil and for generating a high voltage output from said core-coil assembly;

c. said secondary coil comprising a plurality of stacked core-coil sub-assemblies connected in series with each other that are simultaneously energized in response to the voltage excitation of said primary coil, each of said core-coil sub-assemblies comprising a toroidally wound section having a coil wound in a predetermined direction;

d. said core-coil sub-assemblies, when simultaneously energized by said primary coil, producing secondary voltages that are additive and which are collectively fed to a spark plug to generate the ignition event in the internal combustion engine.

2. A spark ignition system as recited by claim 1, wherein said capacitive discharge system further comprises:

a. a voltage converter having an input for receiving a DC voltage input and an output, said voltage converter converting said DC voltage input to said predetermined voltage and presenting said predetermined voltage at said voltage converter output;

b. a main storage capacitor connected to said output of said voltage converter and adapted to charge to a voltage level approximately equal to said predetermined voltage;

c. connecting means connected between said main storage capacitor and said primary coil of said core-coil assembly for selectively connecting said main storage capacitor to said primary coil of said core-coil assembly; and d. means for controlling said connecting means;

e. said main storage capacitor being discharged through said primary coil of said core-coil assembly in said predetermined time period following connection of said main storage capacitor to said primary coil.

3. A spark ignition system as recited by claim 1, wherein said predetermined voltages ranges from about 300 to 600 volts DC.

4. A spark ignition system as recited by claim 2, wherein said connecting means is a silicon controlled rectifier.

5. A spark ignition system as recited by claim 2, wherein said predetermined discharge time is from about 30 microseconds to about 200 microseconds.

6. A spark ignition system as recited by claim 2, wherein said predetermined discharge time is about 60 microseconds.

7. A spark ignition system as recited by claim 1, wherein said predetermined direction alternates between clockwise and counterclockwise for adjacent core-coil sub-assemblies, such that adjacently stacked core-coil sub-assemblies are not wound in the same predetermined direction.

8. A spark ignition system as recited in claim 1, wherein said magnetic core is a heat-treated ferromagnetic amorphous metal alloy.

9. A spark ignition system as recited by claim 1 wherein said magnetic core comprises a plurality of segmented cores.

10. A spark ignition system as recited by claim 1, wherein the voltage in said secondary coil can exceed 10 kV and is linearly related to said predetermined voltage generated by said capacitive discharge system.

11. A spark ignition system as recited by claim 8, wherein said ferromagnetic amorphous metal alloy is iron based and further comprises metallic elements including nickel and cobalt, glass forming elements including boron and carbon, and semi-metallic elements including silicon.

12. A spark ignition system as recited by claim 9, wherein said magnetic core is circumferentially continuous.

13. A spark ignition system as recited by claim 8, wherein said magnetic core is circumferentially discontinuous.

14. A spark ignition system recited by claim 11, wherein said magnetic core is a ferromagnetic amorphous alloy heat-treated at a temperature near the alloy's crystallization temperature and partially crystallized.

15. A spark ignition system as recited by claim 12, wherein said magnetic core is a ferromagnetic amorphous alloy heat-treated below the alloy's crystallization temperature and, upon completion of the heat treatment, remains substantially in an amorphous state.

16. A spark ignition system as recited by claim 1, wherein said secondary coil has an internal voltage distribution that is segmentally stepped from bottom to top, the number of segments being determined by the number of core-coil sub-assemblies comprising said secondary coil.

* * * * *